US006555678B1

(12) United States Patent
Allandrieu et al.

(10) Patent No.: US 6,555,678 B1
(45) Date of Patent: Apr. 29, 2003

(54) METHOD FOR PREPARING A REGENERATED CELLULOSE FIBRE OR YARN

(75) Inventors: Christian Allandrieu, Villeurhanne (FR); Lucile Gambut, Lyons (FR); Philippe Karrer, Mulhouse-Bourtzwiller (FR); Ties Karstens, Boetzingen (DE); Gerard Mignani, Lyons (FR); Armin Stein, Kenzingen (DE)

(73) Assignee: Rhodia Acetow, Freiburg im Breisgau (DE)

( * ) Notice: Subject to any disclaimer, the term of this patent is extended or adjusted under 35 U.S.C. 154(b) by 0 days.

(21) Appl. No.: 09/530,188

(22) PCT Filed: Oct. 26, 1998

(86) PCT No.: PCT/FR98/02289

§ 371 (c)(1),
(2), (4) Date: Sep. 25, 2000

(87) PCT Pub. No.: WO99/22051

PCT Pub. Date: May 6, 1999

(30) Foreign Application Priority Data

Oct. 27, 1997 (FR) ..... 97 13662

(51) Int. Cl.[7] ..... C08B 16/00; C08B 37/00; C07H 1/00; C07H 1/06

(52) U.S. Cl. ..... 536/57; 536/124; 536/127

(58) Field of Search ..... 536/57, 124, 127

(56) References Cited

U.S. PATENT DOCUMENTS 5,410,037 A * 4/1995 Wagner et al. ..... 536/121

FOREIGN PATENT DOCUMENTS

| | | | |
|---|---|---|---|
| EP | 0 621 286 | | 10/1994 |
| FR | 2 477 157 | | 9/1981 |
| GB | 2070508 A | * | 9/1981 |
| GB | 2070612 A | * | 9/1981 |
| JP | 363254101 A | * | 10/1988 |
| WO | 96 30411 | | 10/1996 |

* cited by examiner

*Primary Examiner*—James O. Wilson
*Assistant Examiner*—Everett White
(74) *Attorney, Agent, or Firm*—Burns, Doane, Swecker & Mathis, L.L.P.

(57) ABSTRACT

A method has been developed for making regenerated cellulose yarn. The method includes the steps of spinning a solution derived from cellulose or a cellulose derivative in a molten state through at least one extrusion die, then regenerating the cellulose by treating the resulting yarn, wherein a silylated cellulose derivative is prepared by reaction with a silylating agent; the silylated cellulose is extracted from the synthesis reaction medium; then spun through at least an extrusion die; and the resultant yarn treated with a desilylation agent to regenerate the cellulose and a siloxane. The resulting cellulose yarns or fibers may be used for making woven or knitted textile surfaces or non-woven surfaces. Said yarns or fibers are also useful as reinforcing fibers in elastomeric materials and more particularly, in tires.

26 Claims, No Drawings

METHOD FOR PREPARING A REGENERATED CELLULOSE FIBRE OR YARN

This application is a 371 of PCT/FR98/02289, which was filed Oct. 26, 1998.

The present invention relates to a process for the preparation of a regenerated cellulose fibre or yarn.

For greater clarity, the name "yarn" will be used for the products obtained by the process of the invention, this term denoting, for the requirements of the present description and for the assessment of the scope of the invention, products such as continuous yarns, fibres or rovings, with round or shaped cross sections and with any count.

Regenerated cellulose yarns have been produced for a very long time from a solution of a cellulose derivative such as xanthogenate, in a basic medium. This solution is spun with passage through a coagulation bath and then treatment to decompose the xanthogenic functional group and to regenerate the hydroxyl functional groups of the cellulose. However, this process, which uses carbon disulphide as xanthogenation agent, is very punishing to the environment and generates a great deal of effluent.

More recently, other processes have been provided, including the process known under the name Lyocell, which consists in dissolving the cellulose in an organic solvent, N.MMO (N-methylmorpholine oxide). The solvent is recovered after spinning in spin baths.

Provision has also been made for a process known as the "carbamate" process, which consists in manufacturing a cellulose derivative, cellulose carbamate. This carbamate is obtained by reaction of cellulose with urea. The cellulose carbamate is subsequently dissolved in a sodium hydroxide solution and then spun at low temperature. The cellulose is regenerated by raising the temperature and giving off ammonia.

The latter process is currently in development (see article by A. Urbanowski published in "Chemical Fibers International" of September 1996, pages 260 to 262).

These novel processes, in particular the Lyocell process, require wet spinning. In addition, the fibres obtained by the Lyocell process have different technical characteristics from those of conventional cellulose fibres obtained by the xanthogenation process, as is described in the article by P. A. Koch which appeared in the journal Man-Made Fiber Year Book of September 1997, p. 41 to 47.

A particular aim of the present invention is to provide a process for the manufacture of regenerated cellulose yarns which respects the environment and which makes it possible to obtain yarns which are similar with regard to properties to Viscose or Rayon yarns obtained by the conventional carbon disulphide process.

Another aim of the invention is to provide a process for the manufacture of a regenerated cellulose yarn which makes it possible to carry out the spinning in a molten medium. The latter characteristic makes it possible to improve the profitability of the process as the melt-spinning rates are markedly higher than those of the dry or wet spinning processes.

To this end, the invention provides a process for the manufacture of a regenerated cellulose yarn which consists in spinning a solution of a cellulose derivative or the said cellulose derivative in the molten state through at least one die hole and in then regenerating the cellulose by treatment of the yarn obtained, characterized in that it consists:

in synthesizing a silylated derivative of the cellulose by reaction with a silylating agent, in extracting the said silylated derivative of the cellulose from the synthesis reaction mixture, in spinning the said silylated cellulose derivative, dissolved or brought to the molten state, through at least one die hole, in treating the said yarn with a desilylating agent, in order to regenerate the cellulose and to recover a siloxane, in regenerating the silylating agent from the siloxane recovered in the stage of regeneration of the cellulose.

According to the invention, the cellulose suitable for synthesizing the silylated cellulose can be of plant (wood, cotton, and the like) or animal origin. It can have a variable degree of polymerization DP, for example of between 100 and 5000. The DP of the cellulose is chosen according to the mechanical properties desired for the cellulose yarn to be manufactured.

Cellulose derivatives can also be used to synthesize silylated celluloses, in particular amorphous cellulose derivatives, which are more reactive, such as those substituted by organic radicals with a low degree of substitution DS (less than 1).

The term "degree of substitution DS" should be understood as meaning the mean number of substituted hydroxyl groups per anhydroglucose unit. As each anhydroglucose unit comprises three accessible hydroxyl groups, the maximum degree of substitution DS is equal to 3.

In a preferred embodiment, the process applies particularly to the silylation of polysaccharides, in particular of cellulose, activated by treatment under pressure with ammonia and then explosion of the ammonia-impregnated polysaccharide according to the process disclosed in Patent Application WO 96/01274 or by reduction in pressure of the ammonia atmosphere as disclosed in Patent Application DE 19 51 10 61.

A compound for insertion or for inclusion between the polysaccharide fibres or chains can be added during the phase of activation by ammonia. Thus, this compound, added with the ammonia, preferably dissolved or dispersed in liquid ammonia, is uniformly distributed in the cellulose structure during the stage of pressure reduction or of explosion and keeps the polysaccharide chains separated from one another. The presence of this insertion compound renders the hydroxyl groups of the polysaccharide more accessible.

Mention may be made, by way of examples, as insertion compounds, of primary alcohols, secondary alcohols, phenols, ethers, acetals, ketones, β-keto esters, amides, sulphamides, esters, urea derivatives, amino acids, steroids, mono-, di- or oligosaccharides and/or an aromatic compound comprising a heteroatom. The preferred compound of the invention is ethylene carbonate.

The process of the invention applies even more particularly to celluloses partially substituted by organic groups and more advantageously to cellulose esters or ethers exhibiting a degree of substitution DS of less than 1, advantageously of less than 0.7. These celluloses exhibit a low degree of crystallization, which renders the hydroxyl groups accessible.

According to a novel characteristic of the invention, the silylating agent corresponds to one of the following general formulae:

(I)

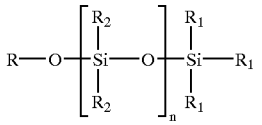

(IV)

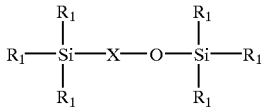

in which:

n is between 0 and 20 inclusive $R_1$ which can be identical or different, represent linear or branched alkyl radicals comprising from 1 to 12 carbon atoms or aromatic radicals $R_2$ which can be identical or different, represent linear or branched alkyl radicals comprising from 1 to 12 carbon atoms or aromatic radicals R represents an alkyl, aralkyl, aryl or alkylaryl radical or radicals of following general formulae:

(II)

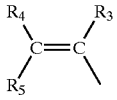

(III)

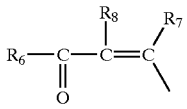

in which:

$R_3$, $R_4$, $R_5$, $R_7$ and $R_8$, which can be identical or different, represent the hydrogen atom or an alkyl group comprising from 1 to 4 carbon atoms $R_6$ represents an alkoxy group or an alkyl group comprising from 1 to 4 carbon atoms, X represents a radical of following formula (V):

(V)

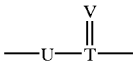

in which:

U represents a carbon, nitrogen, oxygen or sulphur atom,

T represents a carbon, nitrogen, sulphur or phosphorus atom,

V represents an oxygen, sulphur or nitrogen atom, and T is other than U and than V.

According to another preferred characteristic of the invention, the silylation reaction is carried out in the presence of an organic swelling agent having a high dipolar moment which is advantageously higher than that of the alkoxy functional group of the silylating agent of formula (I). This swelling agent improves the accessibility of the hydroxyl groups of the cellulose. This swelling action is of use in particular when the cellulose has not been subjected to a prior activation treatment, such as activation by ammonia or substitution of a portion of the hydroxyl groups by organic radicals.

Mention may be made, as suitable swelling agents, of N-methylpyrrolidone (NMP), dimethylacetamide (DMAC), N-methylmorpholine oxide (NMMO) or dimethylformamide, for example.

The cellulose/swelling agent ratio by mass is advantageously between 0.05 and 0.95, for example between 0.05 and 0.15.

However, the silylation process can be carried out with a cellulose/swelling agent ratio of between 0.15 and 0.95. In this case, it is advantageous to mix a portion of the silylating agent with the cellulose at a low temperature, preferably of between 20° C. and 50° C., in order to allow the silylating agent to spread into the structure of the cellulose, and then, in a second stage, to raise the temperature into the range indicated above and to add the remainder of the silylating agent. The first portion of silylating agent added can represent between 10% and 50% by weight of the total mass of silylating agent to be added.

According to another preferred characteristic of the invention, the silylation reaction is advantageously carried out in the presence of a catalyst, more particularly of a silylation catalyst, that is to say a compound with an acid, protic or Lewis-acid nature or a strong base. Mention may be made, as suitable catalyst, by way of examples, of para-toluenesulphonic acid, the pyridinium salt of para-toluenesulphonic acid, trifluoroacetic acid, para-trifluoromethylbenzenesulphonic acid, trifluorosulphonic acid, hydrochloric acid, ferrous or ferric chlorides, tin chlorides or pyridine.

The amount of this catalyst is not critical and corresponds to a catalytically active amount. By way of example, the amount of catalyst is between 0.1 and 5% by weight with respect to the reaction mass. The catalyst is advantageously used with the silylating agents of formula (I).

On the other hand, the silylation reaction can be carried out without catalysis with the silylating agents of formula (IV). This absence of catalyst can be highly advantageous when the silylated cellulose has to be brought to high temperatures during its use or treatment.

In one embodiment of the invention, the silylation reaction is advantageously carried out at a temperature of between 100° C. and 150° C., preferably between 120° C. and 150° C. This temperature is advantageously determined in order to carry out the reaction with distillation of the alcohol formed. The silylating agent is added all at once to the reaction mixture.

In another embodiment, a first portion of the silylating agent, representing between 10 and 50% by weight of all the silylating agent to be added, is brought into contact at a low temperature, advantageously of between 20° C. and 50° C., with the cellulose to be treated. After maintaining at this low temperature for a certain time, in order in particular to allow the agent to spread into the structure of the cellulose, the mixture is heated to a temperature of greater than 60° C., advantageously of between 60 and 100° C., the remainder of the silylating agent being added to the mixture.

The desired degree of substitution (DS) can be the maximum degree, that is to say 3. However, the process of the invention makes it possible to obtain silylated cellulose compounds exhibiting advantageous properties for a degree of substitution of less than or equal to 3 and preferably of between 1 and 2.5.

The desired degree of substitution can be obtained by controlling either the conditions of duration, temperature and pressure of the reaction or the molar ratio of the silylating agent to the number of cellulose hydroxyl groups. Thus, this ratio will be at least equal to the stoichiometric ratio determined according to the desired degree of substitution. This ratio will preferably be less than 15 times the stoichiometric ratio, calculated with respect to the hydroxyl groups to be silylated.

The silylating agents of general formula (I) which are suitable for the invention are more particularly alkoxysilanes, such as n-butoxytrimethylsilane, tert-butoxytrimethylsilane, sec-butoxytrimethylsilane, isobutoxytrimethylsilane, ethoxytriethylsilane, octyldimethylethoxysilane or cyclohexanoxytrimethylsilane, or alkoxysiloxanes, such as butoxypolydimethylsiloxane.

These silylating agents can advantageously be produced by reaction of an alcohol, such as n-butanol, isobutanol, 2-butanol or cyclohexanol, with a disiloxane, such as hexamethyldisiloxane, in the presence of an acid catalyst, such as para-toluenesulphonic acid.

This preparation of the silylating agent by reaction of an alcohol corresponding to the alkoxy radical of this agent with the disiloxane comprising the silane portions of the silylating agent makes it possible, in the process of the invention for the manufacture of regenerated cellulose yarn, not to consume silylating agent or, as at the very least, to limit this consumption. Thus, the process of the invention is highly economical.

This is because, during the reaction for the silylation of the cellulose, the alcohol formed is advantageously extracted from the reaction mixture by distillation and recovered. Furthermore, the regeneration of the cellulose results in the production of a disiloxane comprising the two silane or siloxane units, grafted beforehand onto the cellulose, connected to one another via an —O— bridge. The silylating agent will be resynthesized by the action of the recovered alcohol on this disiloxane.

The silylating agents of formula (IV) are advantageously obtained by reaction of a compound chosen from the group consisting of $SO_2$, $SO_3$, $CO_2$, $P_2O_5$, $CH_2{=}C{=}O$ and HCNO with a disiloxane, such as hexamethyldisiloxane.

The extraction of the silylated carbohydrate from the reaction mixture can be carried out by several processes, including filtration, centrifuging, precipitation or distillation processes. The silylated compound extracted is advantageously washed with water and solvents, such as acetone, and then dried.

The degree of silylation of the compounds obtained is determined by measuring the increase in weight of the cellulose. This measurement can be corroborated by NMR analysis or quantitative determination of the alkylsilyl units present in the carbohydrate by gas chromatography.

According to the process of the invention, the silylated cellulose is used as starting material for the manufacture of cellulose yarn either by spinning a solution of this silylated cellulose or by melt spinning when the latter exhibits a softening or melting point of less than 350° C., for example of between 200° C. and 300° C., preferably of less than 260° C.

The term "melting or softening temperature" should be understood as meaning the temperature at which the silylated cellulose exhibits a melt flow index compatible with melt-spinning processes.

In the case of spinning a silylated cellulose solution, the silylated cellulose, after extraction from the synthesis reaction mixture, is dissolved in a solvent chosen from the group consisting of N-methylpyrrolidone, dimethylacetamide, dimethylalkylureas, such as dimethylethylurea, formamide, dimethylformamide, tetrahydrofuran, dimethyl sulphone, tetramethylurea and tetramethylfuran, for example.

The concentration of cellulose should be as high as possible for better productivity of the process.

After passing through the die, the solvent can be evaporated (dry spinning). According to another embodiment, the fibre can pass through a coagulation bath, which brings about precipitation or coagulation of the silylated cellulose and extraction of the solvent (wet spinning).

In the case of melt spinning the silylated cellulose, the spinning temperature is advantageously greater than the melting temperature by 5° C.

After melt, dry or wet spinning, the yarn produced is treated with a regeneration medium. This treatment can be carried out by immersing the yarn in or passing the yarn through a regeneration bath. This bath can be a water/alcohol mixture comprising an acid for bringing about desilylation of the cellulose and its regeneration.

The yarn is subsequently washed and dried.

The regenerated cellulose yarn thus obtained can be subjected to all the conventional treatments used in the manufacture of synthetic yarns.

Mention may be made, by way of examples, of drawing, texturing, crimping or relaxing processes. It is also possible to deposit, on its surface, sizing agents for modifying its surface properties, such as hydrophilicity, hydrophobicity, stain-repellency properties or lubrication, for example.

Of course, these yarns can also be dyed.

The regenerated cellulose yarns obtained by the process of the invention are used in particular in the form of continuous yarns or of fibres for the manufacture of woven or knitted textile surfaces or of nonwovens. They are also of use as yarns for reinforcing structures made of synthetic material, such as rubbers. Thus, they are used in reinforcing tyres.

Other advantages, details and aims of the present invention will become more clearly apparent in the light of the examples, given solely by way of indication.

Examples 1 to 15 relate to the synthesis of silylated cellulose according to a process in accordance with the present invention.

EXAMPLE 1

Predried cellulose (0.5 g) with a degree of polymerization of 490 is introduced into 10 ml of anhydrous N-methylpyrrolidone (NMP) with 10 mg of para-toluenesulphonic acid hydrate and 15 ml of n-butoxytrimethylsilane (74.3 mmol).

After purging the reactor with nitrogen, the mixture is heated to 132° C. and 10 ml of n-butoxytrimethylsilane are added dropwise. During this addition, the vapours which distil off are recovered.

After reacting for 2 hours, the reaction mixture is allowed to cool.

The silylated cellulose is recovered by filtration and then washed with dry acetone and with a 50/50 by volume water/acetone mixture.

The product is subsequently dried for 16 hours at 105° C. under reduced pressure.

0.77 g of product is recovered, i.e. an increase in mass of 54%, which corresponds to a degree of substitution DS of 1.2.

The distillate recovered from the reactor comprises n-butanol, n-butoxytrimethylsilane and hexamethyldisiloxane.

EXAMPLE 2

Example 1 is repeated but using isobutoxytrimethylsilane in place of n-butoxytrimethylsilane as silylating agent. The reaction is carried out at a temperature of 122° C. instead of 132° C.

The product obtained exhibits an increase in weight of 71%, which corresponds to a degree of substitution (DS) of 1.6.

EXAMPLE 3

Example 2 is repeated but using sec-butoxytrimethylsilane as silylating agent.

The cellulose derivative obtained exhibits an increase in weight of 119%, corresponding to a DS of 2.65.

EXAMPLE 4

Example 2 is repeated with 1 g of cellulose and, as silylating agent, tert-butoxytrimethylsilane.

The product obtained exhibits an increase in weight of 126%, corresponding to a DS of 2.8.

EXAMPLE 5

10 ml of dry dimethylacetamide and 0.5 g of cellulose with a degree of polymerization of 1100, activated by explosion with ammonia according to the process disclosed in Patent Application WO 96/01274, are added to a reactor. This cellulose comprises 12% by weight of ammonia.

The reactor is placed under a stream of nitrogen in order to remove as much as possible of the ammonia present in the cellulose.

After flushing for 3 hours with nitrogen, 10 mg of para-toluenesulphonic acid hydrate and 15 ml (78 mmol) of tert-butoxytrimethylsilane are introduced. The mixture is heated at reflux at 110° C. for 2 hours. 10 ml (52 mmol) of tert-butoxytrimethylsilane are then added to the reaction mixture. The vapours distilling through the distillation column installed on the reactor are recovered.

After reacting for 6 hours, the reaction mixture is allowed to cool.

The latter is subsequently filtered, the filter cake being washed with dry acetone and then with a 50/50 by volume water/acetone mixture. After drying, the recovered product exhibits an increase in weight of 96%, corresponding to a DS of 2.15.

EXAMPLE 6

Example 5 is repeated but replacing the dimethylacetamide with N-methylpyrrolidone (NMP).

After drying, the product obtained exhibits an increase in weight of 115%, corresponding to a DS of 2.53.

EXAMPLE 7

This test relates to the silylation of a cellulose ester.

0.5 g of cellulose carbamate, exhibiting a degree of polymerization of approximately 350 and a DS as carbamate of 0.17, is added to a reactor with 10 ml of NMP, 10 mg of para-toluenesulphonic acid and 15 ml of n-butoxytrimethylsilane (74.5 mmol).

The reaction mixture is heated to 135° C. and left at reflux for 2 hours. During this heating operation, 10 ml of n-butoxytrimethylsilane are added dropwise. The vapours which distil off are recovered.

The silylated cellulose is recovered from the reaction mixture by diluting the latter with 150 ml of acetone and precipitating by addition of 50 ml of water. The precipitate is filtered off and washed with water and then with ethanol.

The silylated cellulose is dried for 48 hours at 105° C. under reduced pressure.

0.92 g of a slightly yellow powder is obtained.

The degree of substitution (DS), calculated by determining the uptake in weight, is 1.8. This value is corroborated by quantitative analysis of the trimethylsilyl units by reaction with tetraethylsilane and then quantitative determination of the decomposition products by gas chromatography.

Identical tests but with reaction durations of 4 hours and 1 hour result respectively in silylated celluloses with DS values of 2.2 and 0.85.

EXAMPLE 8

Example 7 is repeated but using, as starting material, a cyanoethylated cellulose with a degree of polymerization of approximately 350 and a degree of substitution of 0.2.

The reaction durations are 3 hours, 2 hours and 1 hour. The silylated cellulose obtained exhibits degrees of substitution of 2.1, 1.55 and 0.6 respectively.

EXAMPLE 9

Example 7 is repeated but using, as cellulose material, a cellulose activated by exploding with ammonia according to the process of Patent Application 96/01274. However, the ammonia comprises dissolved ethylene carbonate. The activated cellulose comprises, after exploding and drying at 140° C., ethylene carbonate.

0.65 g of this cellulose, comprising ethylene carbonate and exhibiting a degree of polymerization of approximately 570, was employed.

The silylation reaction was carried out according to the operating conditions described in Example 7.

0.83 g of slightly yellow powder is obtained.

Quantitative determination of the trimethylsilyl units shows that the degree of substitution is 2.5.

EXAMPLE 10

The following are introduced, under a dried nitrogen atmosphere, into a 2 l round-bottomed flask:

- 36.06 g of untreated cellulose with a degree of polymerization of approximately 570
- 700 ml of anhydrous N-methylpyrrolidone
- 1.44 g of para-toluenesulphonic acid hydrate (PTSA) (i.e., 4% by weight of the weight of cellulose)
- 1 l of 99.4% by mass pure n-butoxytrimethylsilane (i.e., 773.2 g or 5.3 mol)

The reaction mixture is brought to 135° C. and left at reflux for 7 h 15. During the heating of the mixture, 626 g of n-butoxytrimethylsilane (i.e. 4.3 mol) are added over 5 h 45. The reaction is monitored by quantitative determination by GC of the n-butanol in the distillate. The reaction mixture is subsequently distilled at 135° C. at atmospheric pressure and then under reduced pressure.

After having allowed the reaction mixture to cool, a brown-coloured mass is obtained. The silylated cellulose is isolated from the solvent and from the catalyst by diluting in acetone and precipitating by addition of water comprising a small amount of sodium hydroxide in order to neutralize the PTSA (catalyst). The precipitate is filtered off by pulling dry and then washed with water and 95% ethanol. The silylated cellulose is dried at 50° C. for 24 hours under reduced pressure.

After milling, 45 g of a slightly yellow powder are obtained. Quantitative analysis of the trimethylsilyl units by reaction of the silylated cellulose with tetraethoxysilane and then quantitative determination of the reaction product, ethoxytrimethylsilane, by gas chromatography, results in a degree of substitution of 1.77.

EXAMPLE 11

A) Preparation of an alkoxysiloxane

The following are introduced into a stirred 25 ml reactor:

12.86 g of silicone oil composed of a polydimethylsiloxane with a degree of polymerization varying from 1 to 8

7.85 g of 2-butanol 10 mg of PTSA.$H_2O$

The reaction mixture is heated at reflux for 51 hours. The unreacted 2-butanol is distilled off.

B) Silylation of the cellulose

The following are introduced into the same equipment as previously:

10 ml of anhydrous NMP 0.50 g of cellulose (predried untreated cellulose with a DP of 490)

The reaction mixture is brought to 100° C. and then kept stirred for 3 hours in order to properly solvate the cellulose. After heating to 125° C., 10.3 g of the alkoxysiloxane prepared in Stage A are added over 2 hours.

After having allowed the reaction mixture to cool, a highly heterogeneous mixture is obtained and the functionalized cellulose is isolated from the solvent and from the catalyst by diluting in 150 ml of acetone and precipitating by addition of 50 ml of water. The precipitate is filtered off and washed with acetone. The silylated cellulose is dried at 105° C. for 16 hours under reduced pressure.

The increase in weight is 11.8%. Quantitative determination of the trimethylsiloxy and dimethylsiloxy units by reaction with tetraethoxysilane and then chromatography of the headspace shows us that 0.8% of trimethylsiloxy units and 10.8% of dimethylsiloxy units have been grafted.

EXAMPLE 12

A) Synthesis of ethoxydimethyloctylsilane

The following are introduced into a round-bottom flask:

27.14 g of absolute ethanol, i.e. 0.59 mol 15.01 g of triethylamine, i.e. 0.15 mol.

An amount of 29.2 g of chlorodimethyloctylsilane, i.e. 0.14 mol, is gradually introduced over 2 h 30 into the reaction mixture. 75.4 g of absolute ethanol are added in order to prevent the mixture setting solid due to the formation of ammonium chloride crystals.

The reaction mixture is subsequently brought to 120° C. over 1 hour. After returning to room temperature, the reaction mixture is concentrated by evaporating and then filtered. 23.74 g of siloxane product are obtained, i.e. a yield of 83% of product pure to more than 95 molar %. The product is characterized by NMR and GC.

B) Silylation of the cellulose

The following are introduced under a dried nitrogen atmosphere into a round-bottomed flask:

0.5 g of cellulose with a degree of polymerization of approximately 490

10 ml of anhydrous N-methylpyrrolidone (NMP)

10 mg of para-toluenesulphonic acid hydrate (i.e., 2% by weight of the total weight)

15 ml of the reactant prepared above, i.e. 5.5 equivalents of silane per alcohol functional group.

The reaction mixture is brought to 123° C. and left at this temperature for 2 h 50 under reduced pressure.

After having allowed the reaction mixture to cool, the reaction mixture is brown in colour and not very viscous. The silylated cellulose is separated from the solvent and from the catalyst by diluting in 150 ml of acetone and precipitating by addition of 50 ml of water.

The precipitate is filtered off and washed with 50 ml of acetone. The silylated cellulose is dried at 105° C. for 16 hours under reduced pressure.

0.8 g is obtained, i.e. an uptake in weight corresponding to a degree of substitution of 0.8.

EXAMPLE 13

The following are introduced under a dried nitrogen atmosphere into a round-bottomed flask:

0.5 g of cellulose with a degree of polymerization of approximately 510

10 ml of N-methylpyrrolidone 10 mg of para-toluenesulphonic acid hydrate (i.e., 2% by weight of the total weight)

15 ml of 97% by mass pure ethoxytriethylsilane (i.e. 11.7 g) sold by the company Fluorochem.

The reaction mixture is brought to 140° C. and left at reflux under reduced pressure for 2 h. During the heating of the mixture, 10 ml of ethoxytriethylsilane are gradually added over 2 hours with distillation of the alcohol formed. The final temperature of the reaction mixture is 141° C.

After having allowed the reaction mixture to cool, a gel is obtained which exhibits a yellow suspension. The silylated cellulose is separated from the solvent and from the catalyst by diluting in 100 ml of acetone and precipitating by addition of 50 ml of water. The precipitate is filtered off and washed with water and then with 95% ethanol. The silylated cellulose is allowed to dry at 105° C. for 48 hours under reduced pressure.

0.7 g of a white powder is obtained. The uptake in weight corresponds to a degree of substitution of 0.7.

EXAMPLE 14

35 g of cellulose pulp, the cellulose having a DP of 510, are treated with liquid ammonia under pressure with an ammonia/pulp ratio by mass of 2/1. The mixture is subjected to a sudden pressure reduction, resulting in the explosion of the cellulose pulp.

The water content of the exploded pulp is less than 3% and the ammonia content is less than 5%.

The exploded pulp is mixed with 140 g of N-methylpyrrolidone in a kneader heated to 40° C.

44 g of N,O-bis(trimethylsilyl)carbamide (BSC) are added to this mixture, which is kept stirred. After holding at 40° C. for one hour, a fresh addition of 44 g of BSC to the reaction mixture is carried out.

The mixture, still kept stirred, is heated to 85° C. and then, after gradually raising the temperature to 100° C., over approximately one hour, 70 g of a liquid paraffin with a boiling point of greater than 110° C. are added to the reaction mixture.

The reaction is continued for three hours, with the temperature being held at approximately 100° C.

The reaction mixture is centrifuged in order to separate the two phases. The paraffin phase comprises the silylated cellulose. This cellulose is recovered by distilling off the liquid paraffin.

The silylated cellulose thus obtained is completely soluble in solvents such as tetrahydrofuran. The degree of substitution of the cellulose (DS) is 2.7.

The DSC spectrum of the silylated cellulose obtained is characterized by a peak corresponding to the melting of the cellulose at a temperature of between 260 and 265° C. and by a glass transition temperature of 110° C.

This thermoplastic silylated cellulose can therefore be shaped by melting.

EXAMPLE 15

4 g of cellulose pulp exploded with liquid ammonia according to the process described in Example 14 are added to 100 ml of NMP, with 20 g of BSC. After heating at 110° C. for 8 hours, a silylated cellulose is obtained which exhibits a degree of substitution of 2.9.

EXAMPLE 16

2.53 g of N,O-bis(trimethylsilyl)carbamide, 1 g of a cellulose with a DP of 570, activated beforehand in ethylene carbonate by explosion with ammonia, and 10 ml of N-methylpyrrolidone are charged, while flushing with nitrogen, to a 25 ml reactor equipped with a stirrer.

The mixture is heated for 5 hours at 115° C. with stirring.

After cooling, the reaction mass is poured into ethanol; the product obtained is filtered off and washed with ethanol. After drying for 16 hours at 105° C. under 50–100 torr, 1.8 g of silylated cellulose with a degree of substitution (DS) of 2.6 are obtained. This DS is established by GC quantitative determination of the ethoxytrimethylsilane formed by ethoxylation with ethyl silicate of the silylated cellulose.

EXAMPLE 17

3.8 g of N,O-bis(trimethylsilyl)carbamide, 500 mg of a cellulose with a DP of 570, activated beforehand in ethylene carbonate by explosion with ammonia, and 10 ml of dimethylacetamide are charged, while flushing with nitrogen, to a 25 ml reactor equipped with a stirrer.

The mixture is heated for 8 hours at approximately 120° C. with stirring.

After cooling, the reaction mass is poured into methanol; the product obtained is filtered off and washed with methanol. After drying for 16 hours at 105° C. under 50–100 torr, 0.92 g of silylated cellulose with a DS of 2.9 is obtained.

EXAMPLE 18

Manufacture of a Regenerated Cellulose Yarn by Wet Spinning

The silylated cellulose obtained in Example 11 with a degree of substitution of 1.8 is dissolved in dimethylacetamide at room temperature at a cellulose concentration by weight of 15%. The solution is filtered and then spun in a die with 20 holes with a round cross section and a diameter of 60 $\mu$m. The spinning pressure is 4 bar and the temperature is 60° C.

The yarns exiting from the die are found in a spin bath comprising 29% by weight of water, 70% of isopropanol and 1% of hydrochloric acid. This bath is at a temperature of 70° C.

During the passage of the yarns through the spin bath, the cellulose is regenerated by production of a hexamethyldisiloxane.

The yarns are drawn according to a draw ratio of 1.5 between two rollers. The spinning rate before drawing is 150 m/min.

The yarns are subsequently washed and dried at 80° C.

The residual silicon level in the yarn is 0.3% by weight, expressed as silicon metal, with respect to the weight of the yarn.

The yarn exhibits a tenacity of 13 cN/tex and an elongation at break of 20%.

The recovered hexamethyldisiloxane is reacted with the n-butanol recovered during the silylation stage in order to regenerate the n-butoxytrimethylsilane.

EXAMPLE 19

Manufacture of a Regenerated Cellulose Yarn by Melt Spinning

The silylated cellulose of Example 11 is fed to a melting vessel of a spinning machine. It is heated under nitrogen to a temperature of 255° C. and is then injected under pressure into a die with a single hole with a diameter of 0.3 mm. The extruded yarn is wound up on a bobbin at a rate of 300 m/min, with a draw ratio of 25. The count of the yarn is 25 dtex.

The yarn is subsequently cut up into fibres with a length of 35 mm.

The fibres are steeped in a silylation bath comprising 29% by weight of water, 79% by weight of isopropanol and 1% of HCl.

After a residence time of 10 minutes, the fibres are recovered, washed with water and then dried.

What is claimed is:

1. Process for the manufacture of a regenerated cellulose yarn comprising spinning a solution of a cellulose derivative or cellulose derivative in the molten state through at least one die hole and regenerating the cellulose by treatment of the yarn obtained, comprising synthesizing a silylated derivative of the cellulose by reaction with a silylating agent, extracting the said silylated derivative of the cellulose from the synthesis reaction mixture, spinning said silylated cellulose derivative, dissolved or brought to the molten state, through at least one die hole, treating said yarn with a desilylating agent, in order to regenerate the cellulose and recover a siloxane and optionally regenerating the silylating agent from the siloxane recovered in the stage of regeneration of the cellulose, wherein the silylating agent corresponds to one of the following general formulae:

(I)

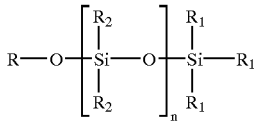

(IV)

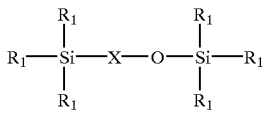

in which:

n is between 0 and 20 inclusive $R_1$ which can be identical or different, represent linear or branched alkyl radicals comprising from 1 to 12 carbon atoms or aromatic radicals $R_2$ which can be identical or different, represent linear or branched alkyl radicals comprising from 1 to 12 carbon atoms or aromatic radicals R represents an alkyl, aralkyl, aryl or alkylaryl radical or radicals of following general formulae:

(II)

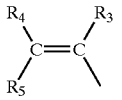

(III)

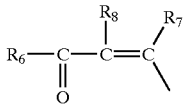

in which:

$R_3$, $R_4$, $R_5$, $R_7$ and $R_8$, which can be identical or different, represent the hydrogen atom or an alkyl group comprising from 1 to 4 carbon atoms, $R_6$ represents an alkoxy group or an alkyl group comprising from 1 to 4 carbon atoms, X represents a radical of following formula (V):

(V)

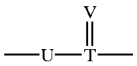

in which:

U represents a hydrocarbonaceous radical, an NH radical or an oxygen or sulphur atom, T represents a hydrocarbonaceous radical or a sulphur or phosphorus atom, V represents an oxygen or sulphur atom or an NH radical, and T is other than U and than V.

2. Process according to claim 1, wherein the cellulose to be silylated comprises a portion of its hydroxyl groups substituted by organic groups.

3. Process according to claim 1, wherein the cellulose to be silylated is treated beforehand in order to improve its reactivity.

4. Process according to claim 3, wherein the prior treatment consists of activation by ammonia under pressure and by pressure reduction or explosion of the mixture.

5. Process according to claim 1, wherein the cellulose has a degree of polymerization of between 100 and 5000.

6. Process according to claim 1, wherein an agent for swelling the cellulose to be silylated is mixed with said cellulose prior to the silylation.

7. Process according to claim 6, wherein the cellulose/swelling agent ratio by mass is between 0.05 and 0.95.

8. Process according to claim 7, wherein the silylating agent corresponds to the general formula (IV) and the cellulose/swelling agent ratio by mass is between 0.15 and 0.95.

9. Process according to claim 7, wherein the silylating agent corresponds to the general formula (I) and the cellulose/swelling agent ratio by mass is between 0.05 and 0.15.

10. Process according to claim 7, wherein the swelling agent is selected from the group consisting of N-methylpyrrolidone, dimethylacetamide, N-methylmorpholine oxide and dimethylformamide.

11. Process according to claim 1, wherein the silylation reaction is carried out in the presence of a silylation catalyst selected from the group consisting of acid catalysts, protic catalysts, Lewis acids and strong bases.

12. Process according to claim 11, wherein the catalyst is selected from the group consisting of para-toluenesulphonic acid, the pyridinium salt of para-toluenesulphonic acid, trifluoroacetic acid, para-trifluoromethylbenzenesulphonic acid, trifluorosulphonic acid, hydrochloric acid, ferrous or ferric chloride, tin chlorides and pyridine.

13. Process according to claim 1, wherein the molar ratio of the silylating agent to the number of hydroxyl groups to be substituted with the cellulose is between the stoichiometric ratio and 15 times said ratio.

14. Process according to claim 1, wherein the silylating agent of general formula (I) is selected from the group consisting of alkoxysilanes, tert-butoxytrimethylsilane, sec-butoxytrimethylsilane, isobutoxytrimethylsilane, ethoxytriethylsilane, octyldimethylethoxysilane or cyclohexanoxytrimethylsilane, and alkoxysiloxanes.

15. Process according to claim 1, wherein the silylating agents of general formula (IV) are obtained by reaction of an alkyldisiloxane with a compound selected from the group consisting of $SO_2$, $So_3$, $CO_2$, $P_2O_5$, $CH_2{=}C{=}O$ and HCNO.

16. Process according to claim 1, wherein a portion of the silylating agent is added to the reaction mixture at a temperature of between 20° C. and 50° C., the other portion of the silylating agent being added to the reaction mixture after heating the latter to a temperature of greater than 60° C.

17. Process according to claim 1, wherein the silylated cellulose is separated from the reaction mixture by precipitation, centrifuging, distillation or filtration.

18. Process according to claim 1, wherein, after the silylation stage, the acid silylation catalyst present in the reaction mixture is neutralized with a base.

19. Process according to claim 1, wherein the silylated cellulose is dissolved in a solvent selected from the group consisting of N-methylpyrrolidone, dimethylacetamide, dimethylalkylureas, formamide, dimethylformamide, tetrahydrofuran, dimethyl sulphone, tetramethylurea and tetramethylfuran.

20. Process according to claim 19, wherein the silylated cellulose solution is spun through at least one die hole, the solvent being evaporated at the outlet of said die.

21. Process according to claim 1, wherein the silylated cellulose is heated to a temperature greater by at least 5° C. than its melting point and then extruded through at least one die hole.

22. Process according to claim 21, wherein the melting temperature of the silylated cellulose is between 200° C. and 350° C.

23. Process according to claim 19, wherein the silylated cellulose yarn is treated with a medium for the regeneration of the cellulose.

24. Process according to claim 23, wherein the regeneration medium is an acidic aqueous solution comprising an alcohol.

25. Process according to claim 1, wherein the regenerated cellulose yarn is subjected to at least one drawing stage.

26. Process according to claim 1, wherein the regenerated cellulose yarn is subjected to treatments selected from the group consisting of treatment by sizing agents, in order to improve the hydrophilicity, hydrophobicity, stain-repellency or lubricating properties, and dyeing, relaxing, texturing and crimping processes.

* * * * *